US012097552B2

(12) United States Patent
Ledoux

(10) Patent No.: US 12,097,552 B2
(45) Date of Patent: Sep. 24, 2024

(54) RIVETING MACHINE AND CORRESPONDING METHOD

(71) Applicant: CYBERMECA, Fontenay le Comte (FR)

(72) Inventor: Didier Ledoux, Fontenay le Comte (FR)

(73) Assignee: CYBERMECA, Fontenay le Comte (FR)

( * ) Notice: Subject to any disclaimer, the term of this patent is extended or adjusted under 35 U.S.C. 154(b) by 0 days.

(21) Appl. No.: 18/569,927

(22) PCT Filed: May 17, 2022

(86) PCT No.: PCT/FR2022/050932

§ 371 (c)(1),
(2) Date: Dec. 13, 2023

(87) PCT Pub. No.: WO2023/281169

PCT Pub. Date: Jan. 12, 2023

(65) Prior Publication Data

US 2024/0278311 A1 Aug. 22, 2024

(30) Foreign Application Priority Data

Jul. 7, 2021 (FR) ..... 2107359

(51) Int. Cl.
*B21J 15/26* (2006.01)
*B21J 15/28* (2006.01)
(Continued)

(52) U.S. Cl.
CPC ..... *B21J 15/26* (2013.01); *B21J 15/285* (2013.01); *B21J 15/32* (2013.01); *B21J 15/42* (2013.01);
(Continued)

(58) Field of Classification Search
CPC . B21J 15/02; B21J 15/142; B21J 15/26; B21J 15/285; B21J 15/32; B21J 15/42;
(Continued)

(56) References Cited

U.S. PATENT DOCUMENTS 2,620,876 A * 12/1952 Harness ..... B21J 15/36 29/34 R
2,978,791 A * 4/1961 Clar ..... B21J 15/02 29/432
(Continued)

FOREIGN PATENT DOCUMENTS

DE 459683 C 5/1928
DE 589134 C 12/1933
(Continued)

OTHER PUBLICATIONS

International Search Report and Written Opinion dated Sep. 19, 2022 in corresponding application No. PCT/FR2022/050932; w/English partial translation and partial machine translation (total xx pages).

*Primary Examiner* — Jermie E Cozart
(74) *Attorney, Agent, or Firm* — Seckel IP, PLLC

(57) ABSTRACT

The riveting machine for riveting two parts has a motorized-drive system (2) with an output shaft, a set (3) of mutually articulated link rods, with a first link rod (31) mounted to rotate with the output shaft and a second link rod (32) articulated to the first link rod (31), a ram (4) articulated to the second link rod (32) at one of its ends and equipped at its opposite end with an upper rivet die (5), a guide device (6) having a through-orifice in which the ram (4) is engaged, and a lower rivet die (9), able to collaborate with the upper rivet die (5) to upset the rivet, when the rivet is placed inside an orifice pierced through the parts, between the upper and lower rivet dies. The rotation of the output shaft drives the movement of the ram (4) to allow, through the link rods (31,
(Continued)

32) moving from a folded position to a deployed position, lowering the upper rivet die (5) to bring the rivet into the orifice.

20 Claims, 12 Drawing Sheets

(51) Int. Cl.

| | |
|---|---|
| ***B21J 15/32*** | (2006.01) |
| ***B21J 15/42*** | (2006.01) |
| *B21J 15/02* | (2006.01) |
| *B21J 15/14* | (2006.01) |
| *B21J 15/44* | (2006.01) |

(52) U.S. Cl.
CPC ..... *B21J 15/02* (2013.01); *B21J 15/142* (2013.01); *B21J 15/44* (2013.01); *Y10T 29/49943* (2015.01); *Y10T 29/49956* (2015.01)

(58) Field of Classification Search
CPC ..... B21J 15/44; Y10T 29/49943; Y10T 29/49956
See application file for complete search history.

(56) References Cited

U.S. PATENT DOCUMENTS

| | | | | |
|---|---|---|---|---|
| 3,111,869 | A * | 11/1963 | Goff | B21J 15/10 227/62 |
| 4,864,713 | A * | 9/1989 | Roberts | B21J 15/10 29/559 |
| 5,060,362 | A * | 10/1991 | Birke | B21J 15/10 29/34 B |
| 5,957,362 | A | 9/1999 | Samulowitz et al. | |
| 2004/0093731 | A1 * | 5/2004 | Sarh | B64F 5/10 29/897.3 |
| 2019/0070657 | A1 | 3/2019 | Skolaude | |
| 2021/0114083 | A1 * | 4/2021 | Ledoux | B21J 15/48 |

FOREIGN PATENT DOCUMENTS

| | | | |
|---|---|---|---|
| DE | 4335318 | A1 | 4/1994 |
| DE | 19516345 | A1 | 11/1996 |
| DE | 19905527 | A1 | 8/2000 |
| DE | 10021781 | A1 | 11/2001 |
| IT | UB20152664 | A1 | 1/2017 |
| JP | H0654441 | U | 7/1994 |
| WO | 2017102668 | A1 | 6/2017 |

* cited by examiner

RIVETING MACHINE AND CORRESPONDING METHOD

FIELD OF THE INVENTION

The present invention concerns in general the riveting of parts, in particular the riveting of aeronautical parts, such as metal fuselage plates.

PRIOR ART

In order to rivet parts, such as metal plates, it is known to use a riveting machine which comprises an upper plate clamp and a lower plate clamp in order to make it possible to clamp the parts to be riveted for the purpose of piercing then riveting them.

The riveting machine comprises a lower rivet die, which is designed to cooperate with an upper rivet die, in order to upset a rivet positioned in the interior of the orifice pierced through the parts to be riveted.

The upper rivet die acts as a tool for retaining the rivet and putting it into place in the orifice pierced. The lower rivet die acts as a thrust tool, and is actuated in order to exert a force on the rivet in the direction of the upper rivet die, and thus upset the rivet in the orifice pierced in the parts to be riveted.

In order to displace the upper rivet die so as to bring the rivet into the orifice pierced, and maintain the upper rivet die in position facing the lower rivet die, it is known to use a system of thrusters.

However, the riveting of parts, in particular in the aeronautical field, may make it necessary for the upper rivet die to be displaced (descent and raising) over a long distance, in particular when obstacles are present in the vicinity of the area to be riveted.

In order to obtain a long course of displacement of the upper rivet die, using a machine of the type known in the prior art, it has been found that it would be necessary to replace the thruster system of the machine by another thruster system with larger dimensions, which would increase the size of the machine.

Document IT UB20 152664 A1 describes a riveting press comprising a frame equipped with an element for guiding of an insertion rod which is movable between a first position, of rest, and a second position, of insertion, the insertion rod being actuated between its first and second positions by an electric motor.

The objective of the present invention is to propose a new machine and a new method for riveting, making it possible to eliminate some or all of the problems described above.

SUMMARY OF THE INVENTION

For this purpose, the subject of the invention is a riveting machine which makes it possible to rivet two parts, such as metal plates, to one another. The machine comprises:

- a motorization system, for example a step motor which is associated with a reduction gear, comprising an output shaft;
- a set of connection rods which are articulated on one another, comprising a first connection rod which is fitted such as to be integral in rotation with the output shaft of the motorization system, and a second connection rod which is articulated on the first connection rod;
- a ram which is articulated on the second connection rod, and is provided at its end opposite the one articulated on the second connection rod with a tool for retention of the rivet and putting it into place, known as the upper rivet die;
- a guide device which is configured to guide the displacement of the ram along a guide axis;
- a thrust element, known as the lower rivet die, which can be displaced in a direction parallel to the guide axis of the guide device, in order to cooperate with the upper rivet die, such as to upset the rivet, when said rivet is positioned in the interior of an orifice pierced through the parts to be riveted, between said upper and lower rivet dies; and
- a control unit which is configured to rotate the output shaft of the motorization system, such as to make the connection rods of the system of connection rods go from a folded position to a deployed position, in which the connection rods are aligned along an axis which intersects the axis of the output shaft of the motorization system.

An arrangement of this type allows the alignment of the connection rods, and the output shaft of the motorization system, to withstand the thrust force applied to the rivet, and to which the upper rivet die which forms the counter-support tool is subjected, reliably, without risk of untimely folding of the connection rods, which thus makes it possible to obtain reliable upsetting of the rivet by thrusting of the lower rivet die in the direction of the upper rivet die, even for a substantial force.

The riveting machine according to the invention can also comprise one or more of the following characteristics, taken in any technically permissible combination.

According to one embodiment, the machine comprises an upper plate clamp and a lower plate clamp making it possible to clamp the parts to be riveted against one another, the upper plate clamp having an opening for the positioning of the rivet carried by the upper rivet die in an orifice pierced through the parts to be riveted, the lower plate clamp having an opening for the passage of the lower rivet die, and thus permitting upsetting of the rivet.

According to one embodiment, the upper plate clamp, which has a cross-section preferably with a generally rectangular form, is fitted such as to pivot around the axis of the ram, in order to allow said upper plate clamp to be displaced along a projecting part of the part to be riveted, on the side of which the upper plate clamp is situated, without interference with this projecting part.

According to one embodiment, the number of connection rods of the set of connection rods is equal to two.

According to one embodiment, the first connection rod has an end through which an orifice is provided, and the output shaft of the motorization system extends through said orifice in the end of the first connection rod.

According to one embodiment, the first connection rod has a median longitudinal axis which intersects the axis of the output shaft of the longitudinal motorization system.

According to one embodiment, the guide device has a through-orifice in which the ram is engaged, the axis of the through-orifice being the guide axis of the ram.

According to one embodiment, the axis of alignment of the connection rods in the deployed state is parallel, and preferably coaxial, with the axis of displacement of the lower rivet die which passes via the center of the lower rivet die.

According to one embodiment, for the passage of the connection rods from the folded position to the deployed position, the angle of rotation of the motorization system is between 20° and 180°.

The invention also relates to a method for riveting by means of a machine according to any one of the preceding embodiments, wherein the method comprises the following steps:

positioning of two parts to be riveted with one another, between the lower rivet die and the upper rivet die;

with an orifice being pierced through the two parts for the introduction of a rivet held by the upper rivet die, actuating the motorization system such as to make the connection rods of the system of connection rods go from said folded position to the deployed position, in which the connection rods are aligned along an axis which is coaxial with the axis of displacement of the lower rivet die, the passage of the connection rods from the folded position to the deployed position giving rise to the descent of the upper rivet die, and bringing of the rivet into the piercing orifice provided through the two parts to be riveted; and displacing the lower rivet die towards the upper rivet die in order to upset the rivet.

BRIEF DESCRIPTION OF THE DRAWINGS

Other characteristics and advantages of the invention will become more apparent from the following description, which is purely illustrative and non-limiting, and which must be read in relation with the appended drawings, in which.

DETAILED DESCRIPTION

Figure 1:
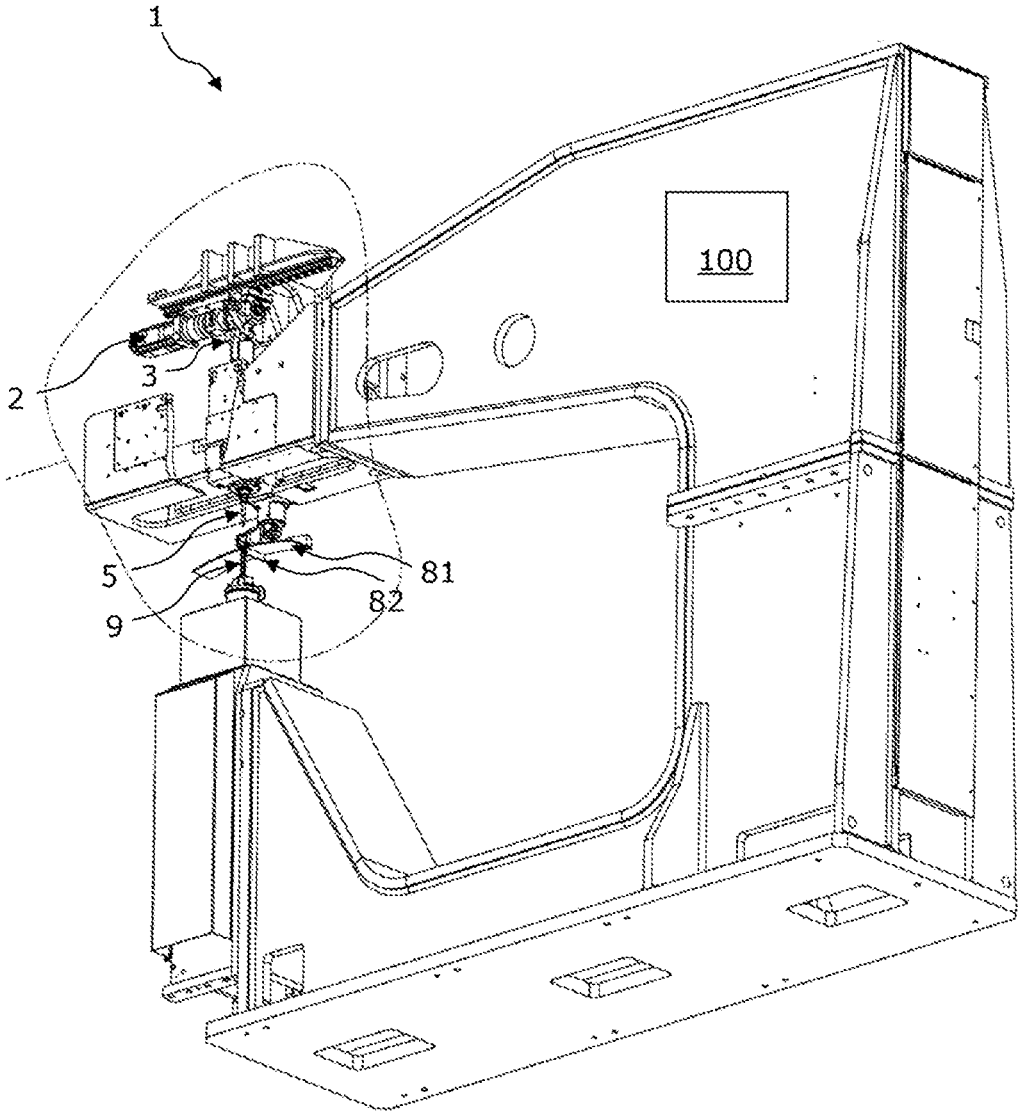
FIG. 1 is a view in perspective of a riveting machine according to an embodiment of the invention.

The concept of the invention is described more completely hereinafter with reference to the appended drawings, in which embodiments of the concept of the invention are shown. In the drawings, the size and the relative sizes of the elements may be exaggerated for purposes of clarity. Similar numerals refer to similar elements in all the drawings. However, this concept of the invention can be implemented in numerous different forms, and should not be interpreted as being limited to the embodiments described here. Instead, these embodiments are proposed such that this description is complete, and communicate the extent of the concept of the invention to persons skilled in the art.

Throughout the specification, a reference to "an embodiment" means that a functionality, a structure, or a particular characteristic described in relation with an embodiment is included in at least one embodiment of the present invention. Thus, the appearance of the expression "according to an embodiment" in various places throughout the specification does not necessarily refer to the same embodiment. In addition, the functionalities, structures, or particular characteristics can be combined in any appropriate way in one or more embodiments.

With reference to the figures, 1 represents a riveting machine which makes it possible to rivet two parts 81, 82, such as metal plates. The machine makes it possible to carry out the riveting operation with a long course of displacement of the upper rivet die, for example 200 mm. The riveting machine makes it possible to apply a high thrust force on the rivet, for example of approximately 100 daN to 10,000 daN, suitable in particular for applications of an aeronautical type.

The thrust force is applied to the rivet by displacement of the lower rivet die, and the upper rivet die acts as a counter-support. In the extension of the upper rivet die 5, the assembly formed by the ram 4, the system of connection rods 3 and the motorization system 2, is designed, as described hereinafter, such as to absorb the thrust force reliably, without risk of folding of the connection rods and rotation of the motorization output shaft.

The use of a motorization system 2, on the shaft of which a system of connection rods 3 is fitted, makes it possible to carry out by simple rotation, for example of approximately a quarter turn, raising and lowering of the upper rivet die at a high pace, for example 0.2 second for a cycle of lowering and raising.

Advantageously, the machine includes a piercing tool to pierce an orifice through the parts to be riveted, into which the rivet can then be brought by the upper rivet die.

Riveting Machine

The riveting machine comprises an upper assembly which comprises an upper rivet die 5 which is connected by a ram and a system of connection rods 3 to a motorization system 2.

The riveting machine also comprises a lower assembly which comprises a lower rivet die 9, which can be displaced, preferably vertically, in the direction of the upper rivet die, in order to be able to exert a thrust force on a rivet positioned in an orifice pierced in the parts to be riveted, such that the rivet is upset between the lower rivet die and the upper rivet die.

Figure 3:
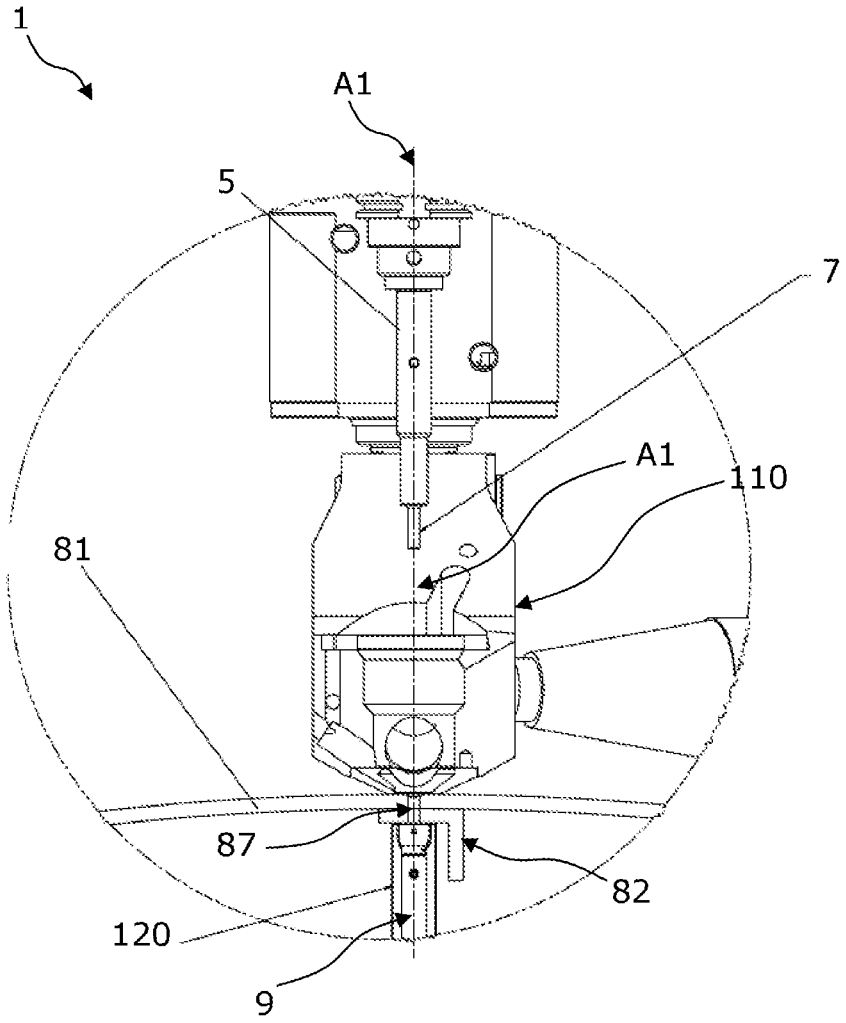
FIG. 3 is a view in cross-section of part of the riveting machine of FIG. 1, showing two parts to be riveted clamped between a lower plate clamp and an upper plate clamp, in the high position of the upper rivet die which carries a rivet, and in the low position of the lower rivet die.
Figure 4:
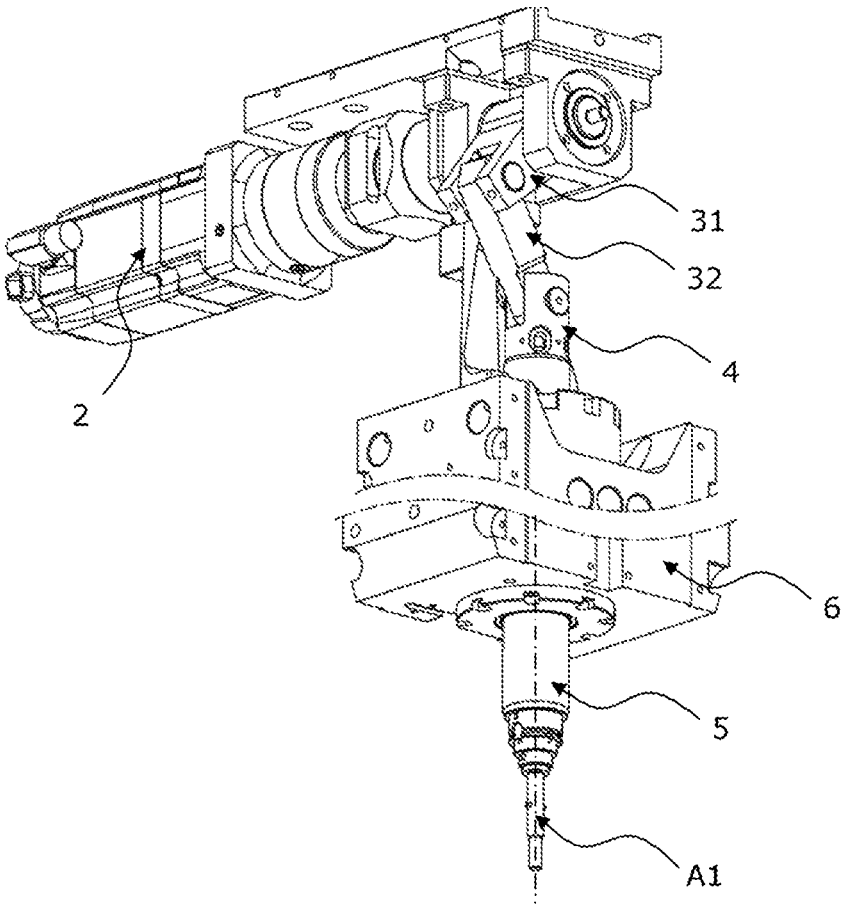
FIG. 4 is a view of the elements of FIG. 2, during deployment of the set of connection rods, giving rise to descent of the ram along the guide device.

In the example illustrated in FIG. 1, the riveting machine has in particular a frame in the form of a "C", with the upper part of the "C" carrying said motorization system, which makes it possible to displace the upper rivet die by means of the system of connection rods 3, and the lower part of the "C" carrying the lower rivet die. The parts to be riveted are positioned in the opening of the "C". During the riveting, the parts 81, 82 to be riveted are maintained pressed against one another by an upper plate clamp 110 and a lower plate clamp 120, as shown in FIG. 3.

Upper Assembly

Figure 2:
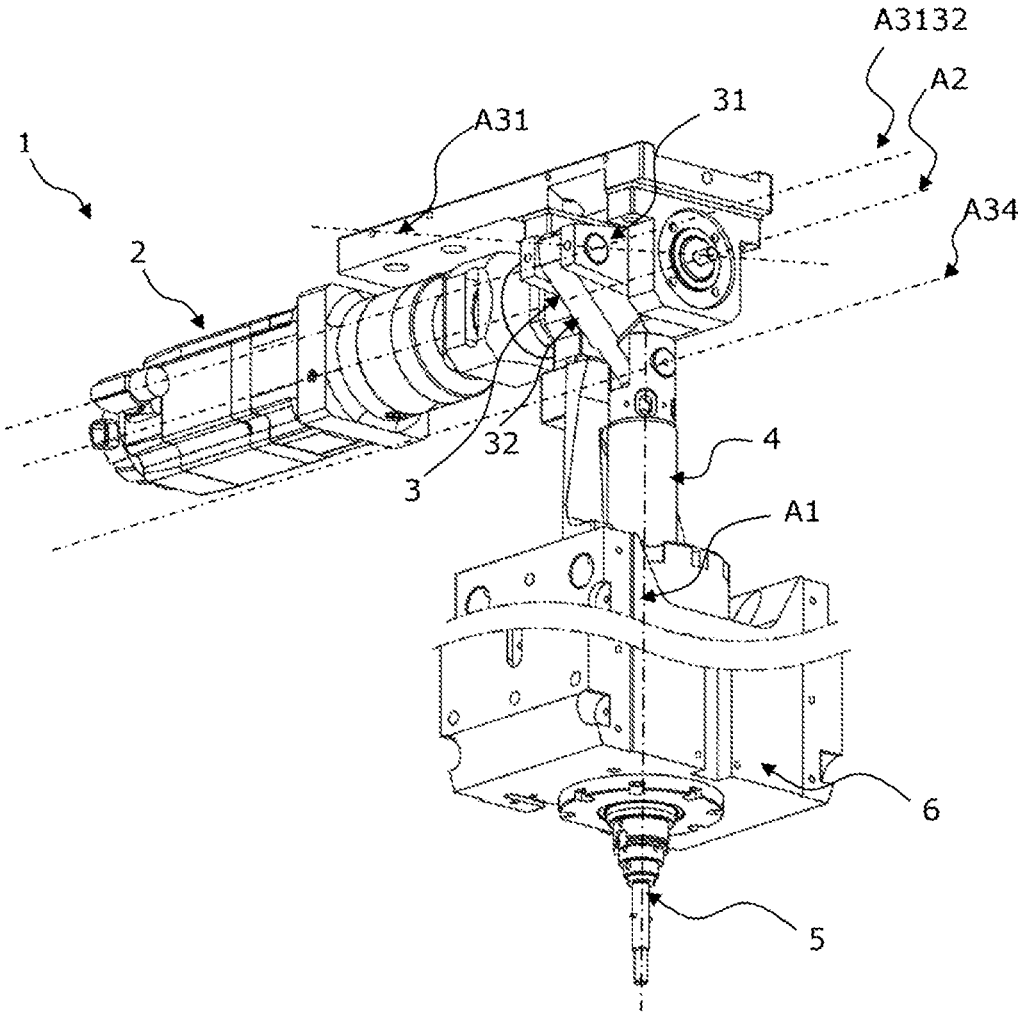
FIG. 2 is a view in perspective of part of the riveting machine of FIG. 1 which comprises a motorization system, with which there is coupled a set of connection rods articulated on a ram provided with an upper rivet die, the displacement of which is guided by a guide device, the set of connection rods being in the folded position.
Figure 2A:
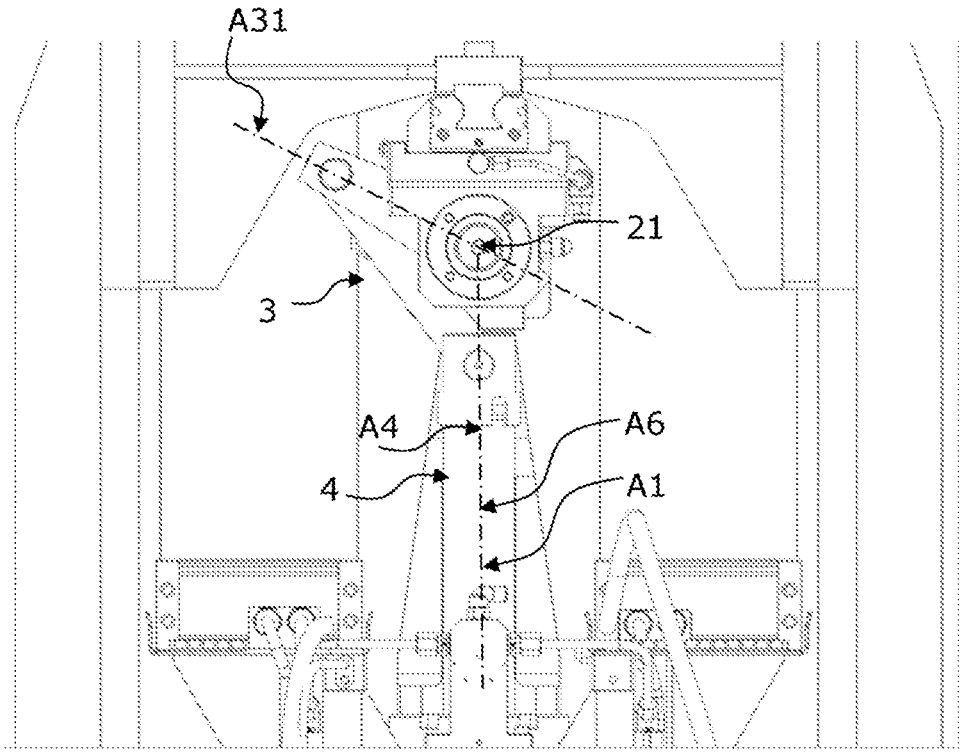
FIG. 2A is a view of part of the riveting machine of FIG. 1, in a front view of the motorization system.
Figure 2B:
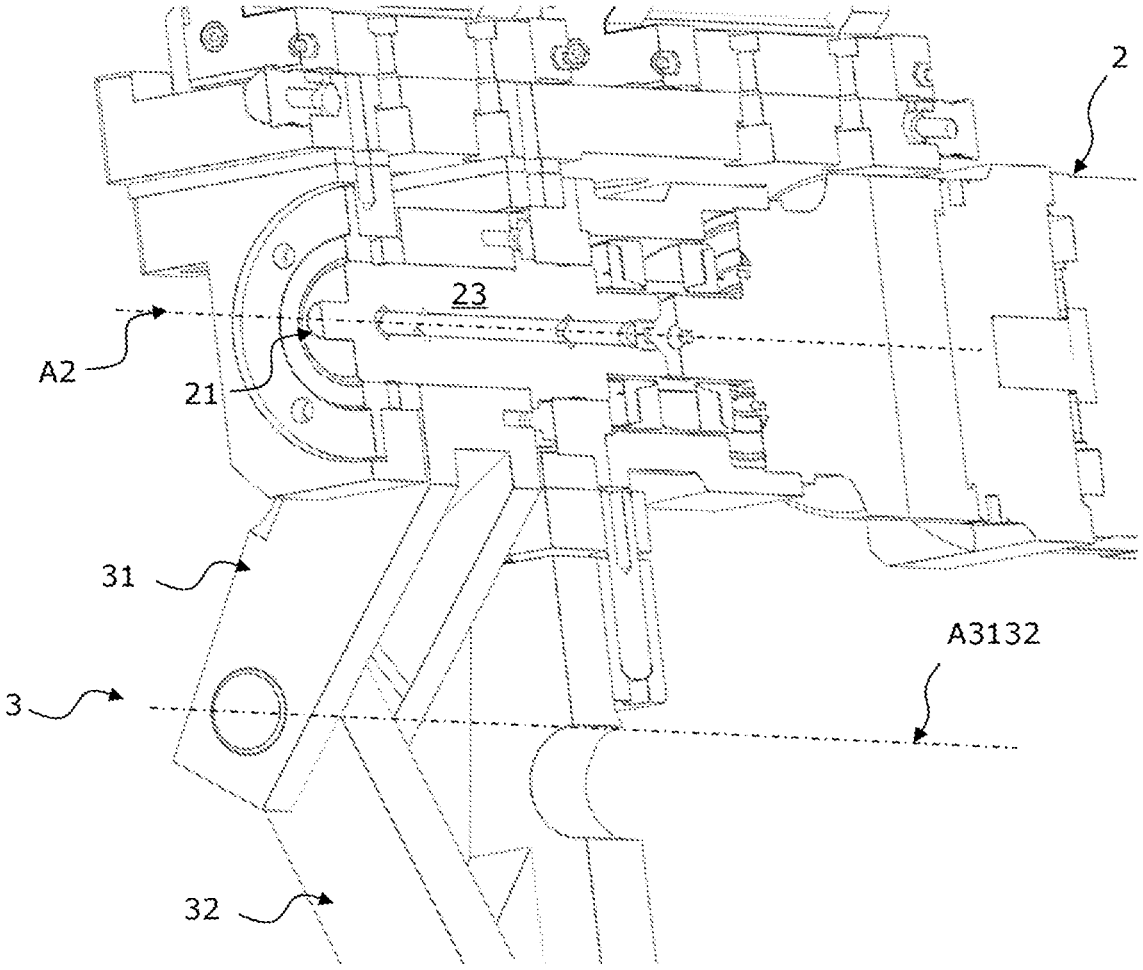
FIG. 2B is a view of part of the riveting machine of FIG. 1, in an axial cross-section of the motorization system.

As illustrated in FIGS. 2A and 2B, the motorization system 2 has an output shaft 21 with an axis A2. The output shaft 21 preferably extends horizontally. Advantageously, the motorization system comprises a gear motor assembly. The motor is preferably a step motor.

The machine also comprises a set 3 of connection rods which are articulated to one another. A first connection rod 31 has an end which is fitted integrally in rotation with the output shaft 21 of the motorization system 2, and a second connection rod 32 is articulated on the other end of the first connection rod 31.

A ram 4 is articulated on the second connection rod 32, and is provided, at its end opposite that which is articulated on the second connection rod 32, with the upper rivet die 5.

According to one embodiment, the first connection rod 31 is secured on the output shaft 21 of the motorization system 2 by shrinking on the output shaft 21 of the motorization system 2.

According to a particular aspect, the end of the connection rod 31 has a through-orifice for its fitting on the output shaft 21. In the example illustrated more particularly in FIGS. 2 and 2B, the end of the connection rod 31 is fitted integrally with the output shaft 21 by means of a fitting part 23, which itself is fitted by shrinking on the output shaft 21. The connection rod 31 is thus integral in rotation with the output shaft 21 of the motorization system.

As illustrated in FIG. 2A, the median longitudinal axis A31 of the first connection rod 31 intersects with the axis A2 of the output shaft 21 of the longitudinal motorization system 2.

The axis of articulation A3132 of the connection rods is parallel to the axis A2 of the output shaft 21 of the motorization system. Similarly, the axis of articulation A34 of the ram 4 on the connection rod 32 is parallel to the axis A2 of the output shaft 21 of the motorization system.

The machine comprises a guide device 6 which makes it possible to guide the ram 4. In the example illustrated in the figures, the guide device 6 has a through orifice in which the ram 4 is engaged. The ram 4 is thus guided in sliding by the guide device 6 according to a direction perpendicular to the axis of the output shaft 21 of the motorization system 2. In the example illustrated in the figures, the ram 4 can thus slide vertically.

Advantageously, the assembly of the motorization system, the connection rods with the ram, and the guide device, is fitted on a carriage which can be displaced along a guide rail along an axis parallel to the axis of the output shaft of the motorization system 2. According to a particular aspect, the guide rail is secured on a support which can be displaced vertically, and optionally horizontally.

Lower Assembly

Figure 6:
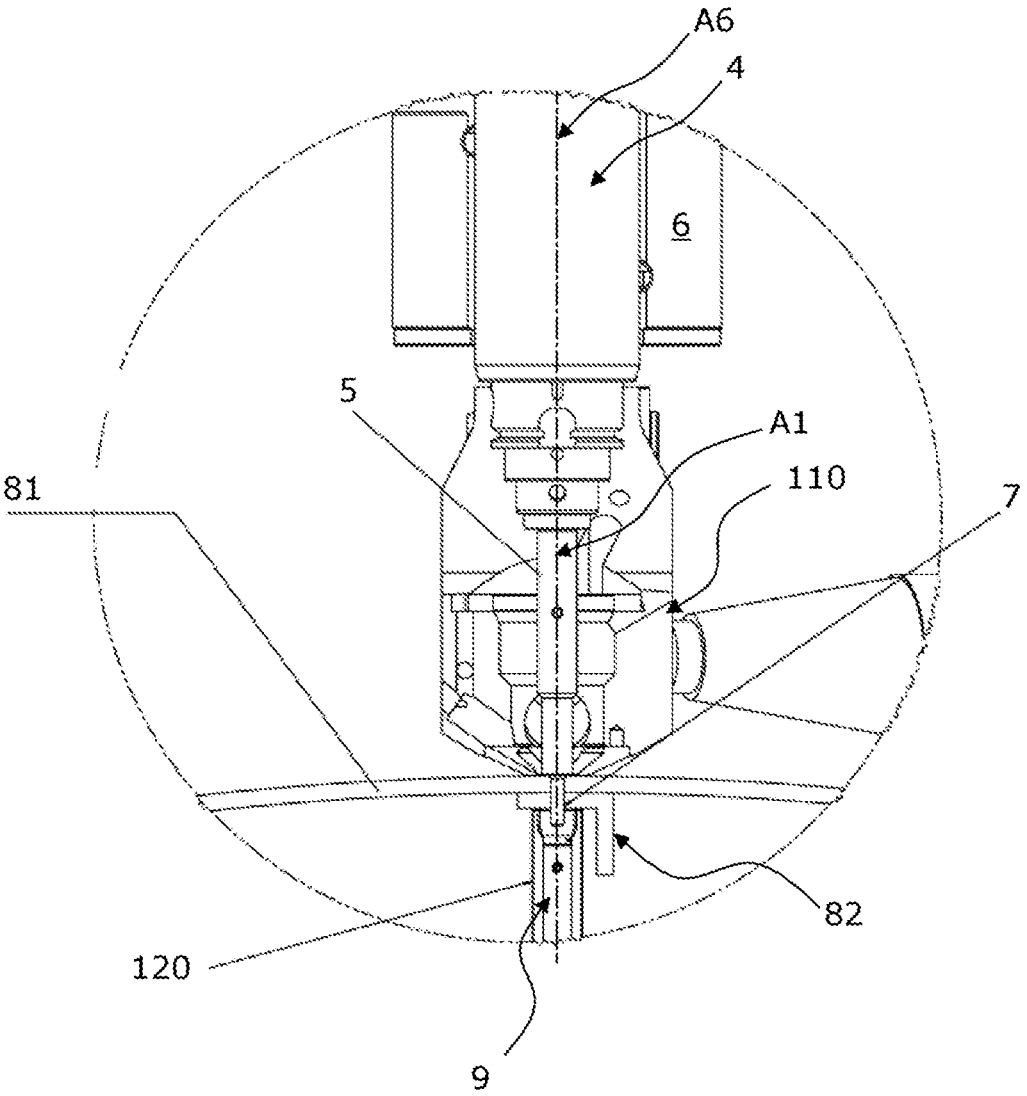
FIG. 6 shows again the elements of FIG. 3, in the low position of the upper rivet die, such that the rivet is inserted in an orifice pierced through the part to be riveted, with the lower rivet die being in the low position.
Figure 7:
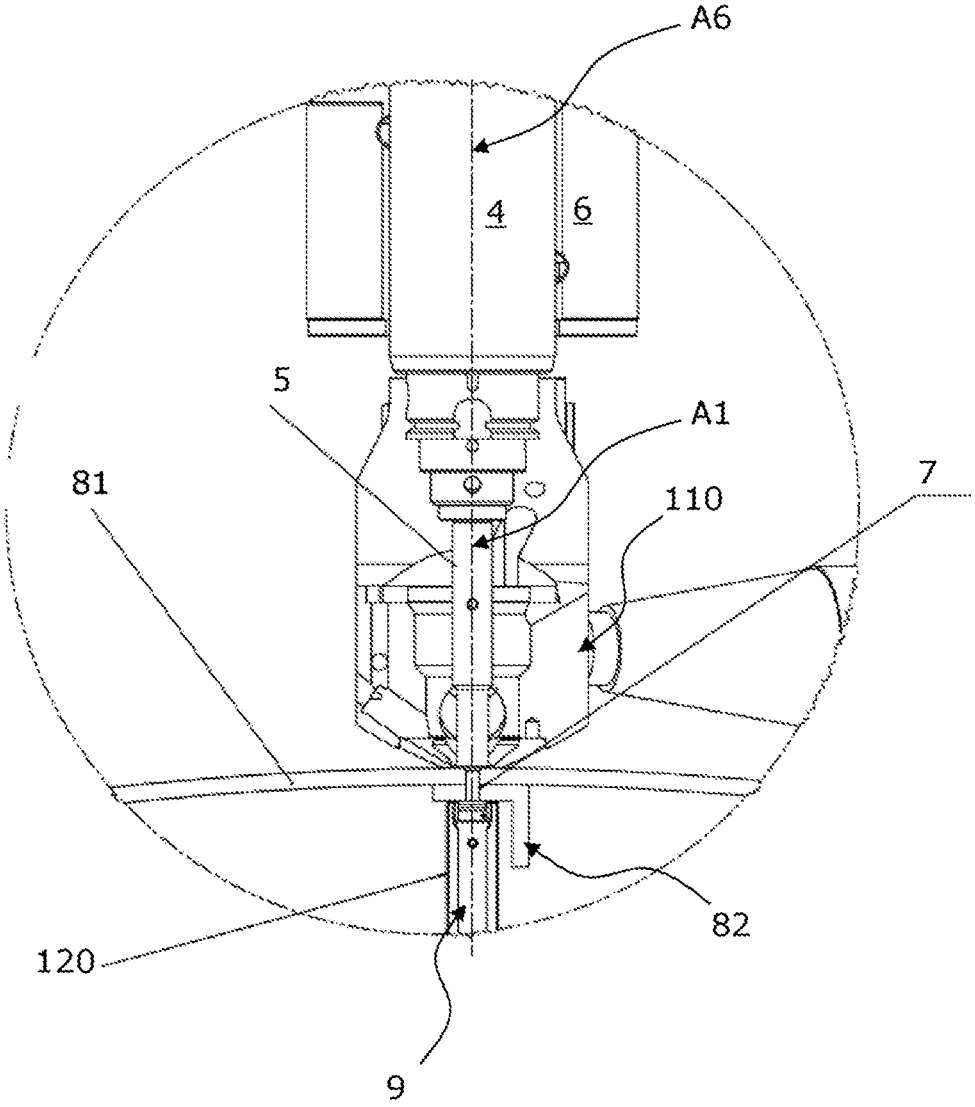
FIG. 7 shows again the elements of FIG. 6, with the lower rivet die being displaced into the high position in order to upset the rivet held by the upper rivet die in the orifice pierced through the parts to be riveted.

The lower rivet die 9 forms a thrust element which can be displaced, preferably vertically, towards the upper rivet die 5, and can cooperate with the upper rivet die 5 in order to upset the rivet 7, when said rivet is positioned in the interior of an orifice 87 pierced through the parts 81, 82 to be riveted, between said lower and upper rivet dies 5, 9 (FIGS. 6-7).

As previously stated, the parts 81, 82 to be riveted are maintained clamped against one another by means of a lower plate clamp 120 and an upper plate clamp 110.

The rotation of the motorization system 2 displaces the ram 4 along the guide device 6, by means of the passage of the connection rods 31, 32 from a folded position (FIGS. 1-4) to a deployed position (FIGS. 5-6), and conversely.

Figure 5:
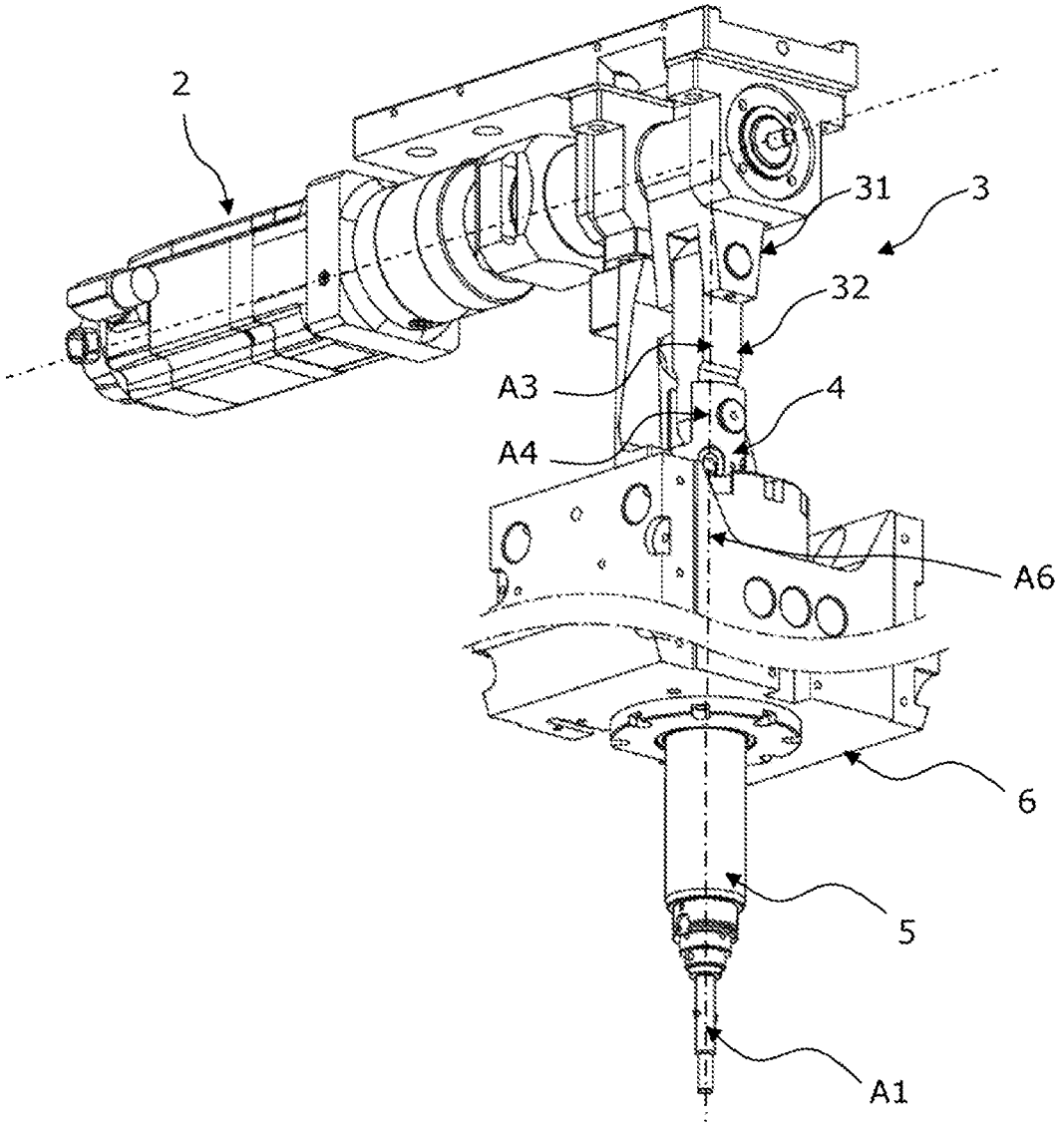
FIG. 5 is a view of the elements of FIG. 4, in the deployed state of the set of connection rods, such that the upper rivet die is in the low position.

As shown in FIG. 5, in the deployed position, the connection rods 31, 32 are aligned along an axis A3 which is coaxial to the axis A6 of guiding 6 of the guide device, i.e. the longitudinal axis A4 of the ram 4, which also corresponds to the thrust axis A1 of the lower rivet die 9. The axis A3 corresponds to the median longitudinal axis of the connection rods in the deployed state.

The axis A2 of the output shaft 21 of the motorization system 2, and the axis A3 of alignment of the connection rods in the deployed position, which also corresponds to the thrust axis A1 of the lower rivet die, are coplanar. An arrangement of this type permits alignment of the connection rods 31, 32, and allows the output shaft 21 of the motorization system 2 to absorb the thrust force of the lower rivet die 9 reliably, without risk of untimely folding of the connection rods, and thus makes it possible to obtain reliable upsetting of the rivet 7 by thrusting of the lower rivet die 9 in the direction of the upper rivet die 5, even for a substantial force.

In the folded position of the connection rods, as illustrated in FIGS. 1-4, the ram is in the high position. The passage to the deployed position of the connection rods makes it possible to displace the ram downwards, and thus to lower the upper rivet die 5, in order to bring the rivet 7 into the piercing orifice 87 provided through the two parts 81, 82 to be riveted.

In the example illustrated in the figures, the direction of introduction and thrust on the rivet is vertical.

The use of a set of connection rods between the motorization system and the upper rivet die makes it possible to displace the upper rivet die over a long course which depends on the length of the connection rods. Since the connection rods are elongate element such as rods, their width is limited, such that the machine can easily be designed to permit the clearance of the connection rods, whilst maintaining a limited size of the machine.

Upper Plate Clamp and Lower Plate Clamp

As illustrated in FIGS. 1 to 7, the machine comprises an upper plate clamp 110 and a lower plate clamp 120 which make it possible to clamp the parts 81, 82 to be riveted against one another.

The upper plate clamp 110 has an opening for the positioning of the rivet 7 carried by the upper rivet die 5 in an orifice pierced through the parts 81, 82 to be riveted.

The lower plate clamp 120 has an opening for the passage of the lower rivet die 5, and thus to permit the upsetting of the rivet 7 against the upper rivet die 5, in the orifice pierced through the parts 81, 82 to be riveted. The lower rivet die 5 can be displaced along the axis A1, preferably vertically, in order to thrust on the rivet, and thus upset it, whereas the upper rivet die, and the assembly formed by the ram, the connection rods and the drive shaft, absorb the thrust force of the lower connection rod.

Figure 8:
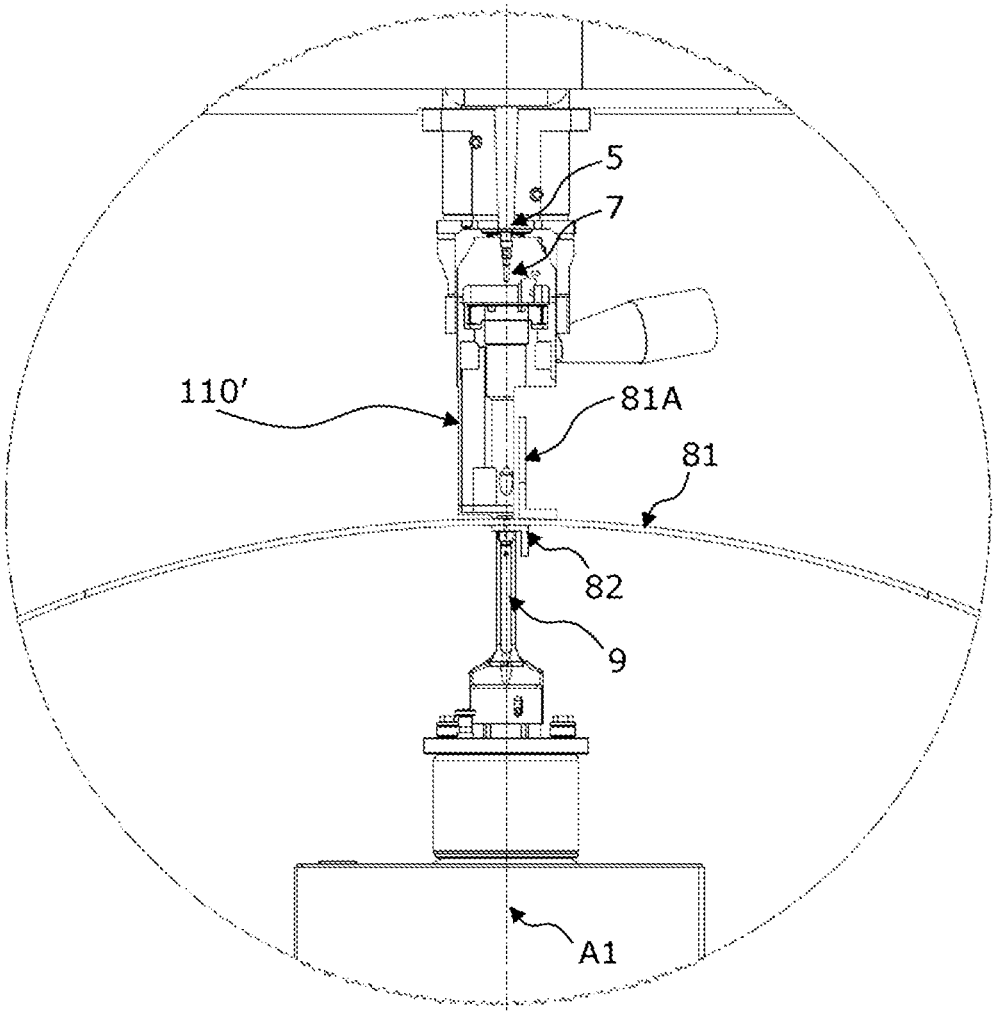
FIG. 8 is a view in cross-section of part of a riveting machine according to another embodiment of the invention, for which the upper plate clamp is movable in pivoting around an axis parallel to the axis of displacement upwards and downwards of the upper rivet die, with FIG. 8 showing the upper rivet die in the high position, such that the rivet is not yet introduced into the orifice pierced through the parts to be riveted.
Figure 9:
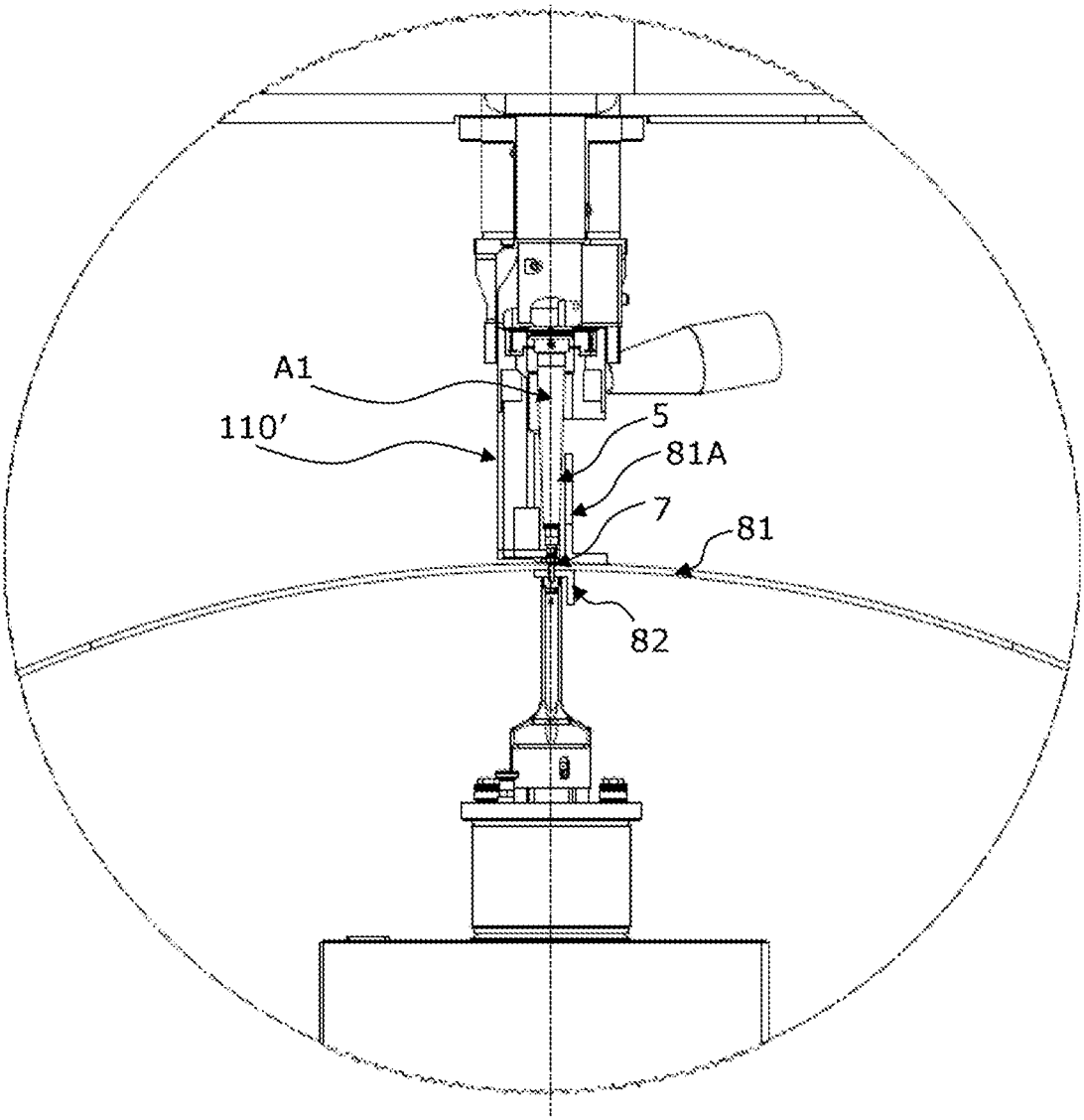
FIG. 9 shows again the elements of FIG. 8, in the low position of the upper rivet die, such that the rivet is introduced into the orifice pierced through the parts to be riveted.

According to a particular embodiment illustrated in FIGS. 8 and 9, the upper plate clamp 110' is fitted such as to pivot around an axis which is parallel, and preferably coaxial, to the axis A4 of the ram 4, which also corresponds to the axis A1 of displacement of the lower rivet die (or also the axis of the orifice pierced in the parts to be riveted).

The pivoting of the upper plate clamp 110' around itself allows said upper plate clamp 110' to be displaced along a projecting part 81A of the part 81 to be riveted, on the side of which the upper plate clamp 110' is located, without interference with this projecting part 81A.

The upper plate clamp 110' has a cross-section with a form which is preferably generally rectangular and extends along the axis A1.

Method

Figure 10:
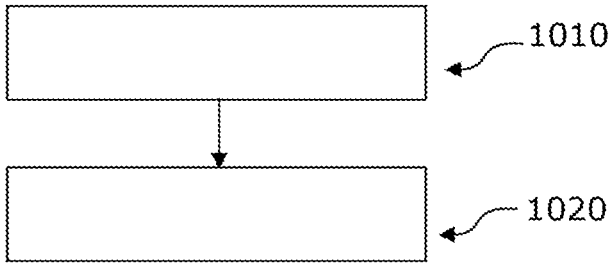
FIG. 10 is a flowchart illustrating the steps of a method according to an embodiment of the invention.

The riveting machine 1 presented above makes it possible to implement a riveting method, an embodiment of which is proposed hereinafter in association with FIG. 10.

The connection rods 31, 32 are in the folded position, such that the upper rivet die 5 is in the high position. The upper rivet die 5 is positioned above an orifice pierced through the two parts 81, 82 to be riveted.

In order to introduce the rivet 87 into an orifice pierced through the parts 81, 82 to be riveted, the motorization system 2 is supplied with power in order to turn in the direction of a deployment of the connection rods (step 1010), preferably by approximately a quarter turn.

The rotation of the motorization system 2 thus displaces the ram 4 along the guide area of the guide device 6, which is a through orifice in the example illustrated in the figures, in the direction of (vertical) descent of the upper rivet die 5.

In the step 1020, the lower rivet die 9 is displaced towards the upper rivet die 5, in order to thrust on the rivet 7 and upset it, with the thrust force being absorbed by the assembly formed by the upper rivet die 5, the ram 4, the set of connection rods 3 and the output shaft 21 of the motorization system.

The motorization system 2 and the displacements of the different elements, such as the lower rivet die 9, and, according to the embodiment selected, the rotation of the upper plate clamp 10', can be controlled by a control unit 100 (FIG. 1).

The control unit 100 can be in the form of a processor and a data memory in which computer instructions which can be executed by said processor can be stored, or also in the form of a microcontroller.

In other words, the functions and steps described can be implemented in the form of a computer program, or via hardware components (for example programmable gate networks). In particular the functions and steps carried out by the control unit, in particular for the command for actuation of the lower rivet die, for the command for the motorization system, for a motor/motors associated with the carriage(s) for displacement of the assembly which carries the motorization system with which the upper rivet die and the sliding guide device are coupled, and optionally for control of the rotation of the upper plate clamp, can be carried out by sets of instructions or computer modules implemented in a processor or controller, or can be carried out by dedicated electronic components or components of the FPGA or ASIC type. It is also possible to combine computer parts and electronic parts.

The control unit is thus an electronic and/or computer unit. When it is specified that said unit is configured to carry out a given operation, this means that the unit comprises computer instructions and corresponding execution means which make it possible to carry out said operation, and/or that the unit comprises corresponding electronic components.

The invention is not limited to the embodiments illustrated in the drawings.

Furthermore, the term "comprising" does not exclude other elements or steps. In addition, characteristics or steps which have been described with reference to one of the embodiments described above can also be used in combination with other characteristics or steps of other embodiments described above.

The invention claimed is:

1. A riveting machine to rivet two parts to one another, the machine comprising:

a motorization system comprising an output shaft;

a set of connection rods articulated on one another, comprising a first connection rod fitted to be integral in rotation with the output shaft of the motorization system, and a second connection rod articulated on the first connection rod;

a ram articulated on the second connection rod at a first end of the ram, and provided at a second end of the ram opposite the first end with an upper rivet die, the upper rivet die being a tool for retention of a rivet and for positioning the rivet;

a guide device configured to guide the displacement of the ram along a guide axis;

a lower rivet die, the lower rivet die being a thrust element able to be displaced in a direction parallel to the guide axis of the guide device, in order to cooperate with the upper rivet die to upset the rivet when the rivet is positioned inside an orifice pierced through the parts to be riveted, between the upper and lower rivet dies; and a control unit configured to rotate the output shaft of the motorization system (2), to make the connection rods go from a folded position to a deployed position in which the connection rods are aligned along an axis which intersects the axis of the output shaft of the motorization system.

2. The machine as claimed in claim 1, wherein the machine comprises an upper plate clamp and a lower plate clamp making it possible to clamp the parts to be riveted against one another, the upper plate clamp having an opening for positioning of the rivet carried by the upper rivet die in an orifice pierced through the parts to be riveted, the lower plate clamp having an opening for passage of the lower rivet die, and thus permitting upsetting of the rivet.

3. The machine as claimed in claim 2, wherein the upper plate clamp is fitted so as to pivot around an axis of the ram, in order to allow the upper plate clamp to be displaced along a projecting part of one of the parts to be riveted, the upper plate clamp being situated on a side of the projecting part, without interference with the projecting part.

4. The machine as claimed in claim 2, wherein a number of connection rods of the set of connection rods is two.

5. The machine as claimed in claim 2, wherein the first connection rod has an end through which an orifice is provided, and the output shaft of the motorization system extends through the orifice in the end of the first connection rod.

6. The machine as claimed in claim 2, wherein the first connection rod has a median longitudinal axis which intersects the axis of the output shaft of the motorization system.

7. The machine as claimed in claim 3, wherein the upper plate clamp has a cross-section having a generally rectangular form.

8. The machine as claimed in claim 3, wherein a number of connection rods of the set of connection rods is two.

9. The machine as claimed in claim 3, wherein the first connection rod has an end through which an orifice is provided, and the output shaft of the motorization system extends through the orifice in the end of the first connection rod.

10. The machine as claimed in claim 3, wherein the first connection rod has a median longitudinal axis which intersects the axis of the output shaft of the motorization system.

11. The machine as claimed in claim 1, wherein a number of connection rods of the set of connection rods is two.

12. The machine as claimed in claim 11, wherein the first connection rod has an end through which an orifice is provided, and the output shaft of the motorization system extends through the orifice in the end of the first connection rod.

13. The machine as claimed in claim 1, wherein the first connection rod has an end through which an orifice is provided, and the output shaft of the motorization system extends through the orifice in the end of the first connection rod.

14. The machine as claimed in claim 1, wherein the first connection rod has a median longitudinal axis which intersects the axis of the output shaft of the motorization system.

15. The machine as claimed in claim 1, wherein the guide device has a through-orifice in which the ram is engaged, an axis of the through-orifice being an axis guiding the ram.

16. The machine as claimed in claim 1, wherein an axis of alignment of the connection rods in the deployed state is parallel with an axis of displacement of the lower rivet die, wherein the axis of displacement of the lower rivet die passes through a center of the lower rivet die.

17. The machine as claimed in claim 16, wherein the axis of alignment of the connection rods in the deployed state is coaxial with the axis of displacement of the lower rivet die.

18. The machine as claimed in claim 1, wherein, for the movement of the connection rods from the folded position to the deployed position, an angle of rotation of the motorization system is in a range of from 20° to 180°.

19. A method for riveting using the machine as claimed in claim 1, wherein the method comprises:

positioning the two parts to be riveted with one another, between the lower rivet die and the upper rivet die;

an orifice being pierced through the two parts for the introduction of the rivet held by the upper rivet die, actuating the motorization system to make the connection rods go from the folded position to the deployed position, in which the connection rods are aligned along an axis which is coaxial with an axis of displacement of the lower rivet die, the movement of the connection rods from the folded position to the deployed position causing the descent of the upper rivet die, and bringing the rivet into the orifice; and displacing the lower rivet die towards the upper rivet die to upset the rivet.

20. The machine as claimed in claim 1, wherein the motorization system includes a step motor which is associated with a reduction gear.

* * * * *